US010569837B2

(12) United States Patent
Kennemur

(10) Patent No.: US 10,569,837 B2
(45) Date of Patent: Feb. 25, 2020

(54) STANDING SUPPORT ASSEMBLY FOR BOAT DECK

(71) Applicant: Eddie Kennemur, Trussville, AL (US)

(72) Inventor: Eddie Kennemur, Trussville, AL (US)

( * ) Notice: Subject to any disclaimer, the term of this patent is extended or adjusted under 35 U.S.C. 154(b) by 0 days.

(21) Appl. No.: 15/249,123

(22) Filed: Aug. 26, 2016

(65) Prior Publication Data

US 2018/0057120 A1 Mar. 1, 2018

(51) Int. Cl.
*B63B 17/04* (2006.01)
*B63B 17/00* (2006.01)

(52) U.S. Cl.
CPC ..... *B63B 17/00* (2013.01); *B63B 17/04* (2013.01); *B63B 2017/0054* (2013.01)

(58) Field of Classification Search
CPC ..... B63B 29/06; B63B 29/00; B63B 17/04; B63B 2029/043; B63B 2017/0054
USPC ..... 114/362, 363, 364
See application file for complete search history.

(56) References Cited

U.S. PATENT DOCUMENTS 4,803,945 A 2/1989 Adams et al.
4,893,578 A 1/1990 Doerfer et al.
5,329,871 A * 7/1994 Gibbs ..... B63B 29/04 114/363
D367,032 S 2/1996 Fentress et al.
5,784,983 A * 7/1998 Stegall ..... A47C 9/025 114/363
7,222,832 B2 * 5/2007 Welker ..... A47C 3/38 248/157
7,726,729 B2 6/2010 Groll
7,789,035 B1 * 9/2010 Rosenberg ..... B63B 43/14 114/347
8,196,541 B2 * 6/2012 Buxton ..... B63B 29/04 114/218
8,590,478 B2 * 11/2013 Lipman ..... B63B 35/71 114/347
9,475,554 B2 * 10/2016 Heimerl ..... B63B 29/04
9,555,862 B1 * 1/2017 Sutherland ..... B63B 17/04
2012/0199059 A1 * 8/2012 Spitzack ..... B63B 21/00 114/362
2014/0346835 A1 * 11/2014 Baznik ..... B60N 2/64 297/452.39
2016/0194059 A1 * 7/2016 Canaris ..... B63B 27/146 114/362

* cited by examiner

*Primary Examiner* — Andrew Polay

(57) ABSTRACT

A standing support assembly for a boat deck to assist boaters with physical limitations in maneuvering around a bass boat. The standing support assembly includes a rigid, elongated stanchion member that is hingedly attached to one end of a rigid, planar attachment plate. An anchor post extends downwardly from the other end of the attachment plate and allows the standing support assembly to be locked into a base plate on a bass boat. Through its hinged attachment, the stanchion member is able to move between a deployed position in which it is orthogonal to the attachment plate and a storage position in which it is parallel and adjacent to the attachment plate. When in the deployed position, a user can hold the stanchion member for added support while moving around on the boat.

9 Claims, 3 Drawing Sheets

STANDING SUPPORT ASSEMBLY FOR BOAT DECK

BACKGROUND OF THE INVENTION

Field of the Invention

This invention relates generally to boat attachments and, more particularly, to a hingedly deployable support for a standing user on a boat for installation on the deck of a bass boat.

Description of the Prior Art

The design and use of conventional bass boats is well known. A problem which still exists, however, is that boaters with physical limitations, such as elderly or wounded boaters, often need assistance supporting their own body weight while moving to and from the floor of a bass boat and the fishing deck. Thus, there remains a need for a standing support assembly for a boat deck that provides a deployable support that is integral with the boat deck. It would be helpful if such a standing support assembly for a boat deck employed a support that was hingedly deployable to allow for ease of use and storage. It would be additionally desirable for such a standing support assembly for a boat deck to include a mount suited to attach to conventional bass boat decks.

The Applicant's invention described herein provides for a standing support assembly adapted to selectively provide support to a boater attempting to move between the floor of a bass boat and the fishing deck. The primary components in Applicant's standing support assembly for a boat deck are a stanchion member, an attachment plate, and an anchor post. When in operation, the standing support assembly for a boat deck enables many boaters with physical limitations to maneuver around a bass boat without substantial assistance. As a result, many of the limitations imposed by prior art structures are removed.

SUMMARY OF THE INVENTION

A standing support assembly for a boat deck to assist boaters with physical limitations in maneuvering around a bass boat. The standing support assembly comprises a rigid, elongated stanchion member that is hingedly attached to one end of a rigid, planar attachment plate. An anchor post extends downwardly from the other end of the attachment plate and allows the standing support assembly to be locked into a base plate on a bass boat. Through its hinged attachment, the stanchion member is able to move between a deployed position in which it is orthogonal to the attachment plate and a storage position in which it is parallel and adjacent to the attachment plate. When in the deployed position, a user can hold the stanchion member for added support while moving around on the boat.

It is an object of this invention to provide a standing support assembly for a boat deck that provides a deployable support that is integral with the boat deck.

It is another object of this invention to provide a standing support assembly for a boat deck that employs a support that was hingedly deployable to allow for ease of use and storage.

It is yet another object of this invention to provide a standing support assembly for a boat deck which includes a mount suited to attach to conventional bass boat decks.

These and other objects will be apparent to one of skill in the art.

DETAILED DESCRIPTION OF THE INVENTION

Figure 1:
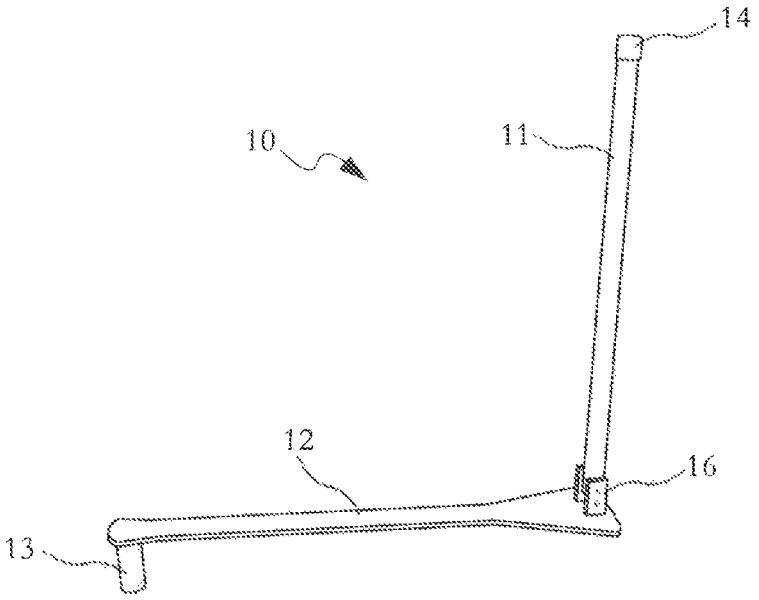
FIG. 1 is a side perspective view of a standing support assembly for a boat deck built in accordance with the present invention with the stanchion member in a deployed position.
Figure 2:
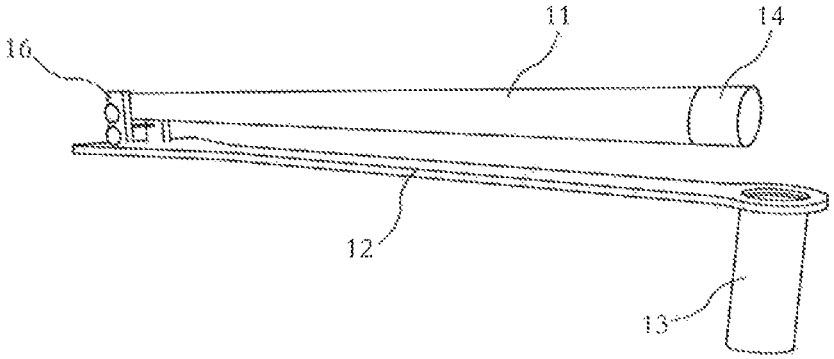
FIG. 2 is a side perspective view of a standing support assembly for a boat deck built in accordance with the present invention with the stanchion member in a storage position.
Figure 3:
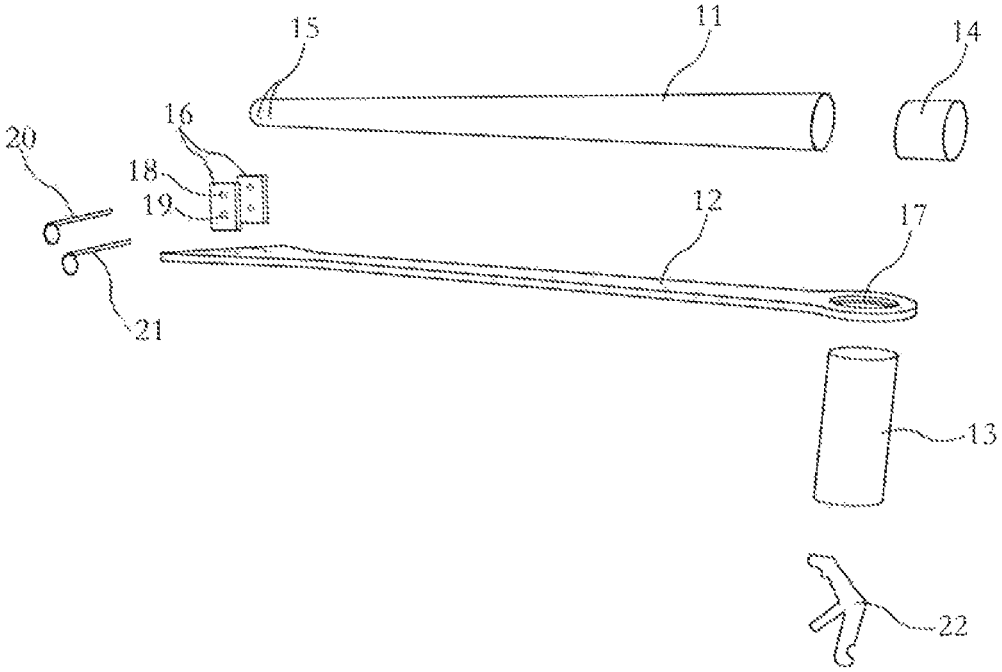
FIG. 3 is an exploded side perspective view of a standing support assembly for a boat deck built in accordance with the present invention.

Referring now to the drawings and in particular FIGS. 1, 2, and 3, a standing support assembly 10 for a boat deck is shown having a stanchion member 11 that is movably attached to an attachment plate 12 that includes an anchor post 13. The stanchion member 11 defines a rigid, elongated body that includes at one end an end cap 14 and at the other end has two attachment apertures 15 which extend through the body. The attachment plate 12 defines a rigid, planar portion that has at one end two attachment brackets 16 extending upwardly therefrom and at the other end a post aperture 17 which extends though the plate 12. Each of the attachment brackets 16 include an upper bracket aperture 18 and a lower bracket aperture 19, with these bracket apertures 18, 19 positioned so that when the attachment brackets 16 are in place on the attachment plate 12, the respective upper bracket aperture 18 and lower bracket aperture 19 on each attachment bracket 16 is horizontally and vertically aligned. The anchor post 13 defines a hollow cylinder and is fixed in the post aperture 17, positioned to extend downwardly from the attachment plate 12.

The stanchion member 11 is hingedly attached to the attachment plate 12 by a locking pin 20 which extends through the upper bracket aperture 18 of one of the attachment brackets 16, the uppermost attachment aperture 15 on the stanchion member 11, and the upper bracket aperture 18 of the other attachment bracket 16. A pivot pin 21 is additionally passed through the lower bracket aperture 19 of one of the attachment brackets 16 and the lower bracket aperture 19 of the other attachment bracket 16 so as to prevent the stanchion member 11 from hinging beyond the deployed position.

At its lower end, the anchor post 13 is structurally identical to the locking portion of a Spring Lock™ Locking Post, such as the Springfield Marine Part #1640404. In this regard, the anchor post 13 includes a locking latch 22 positioned in its hollow interior and is adapted to be selectively inserted and locked in a conventional base plate on the a boat, such as a Locking Spring-Lock™ Base manufactured by Springfield Marine.

In constructing one embodiment of the standing support assembly 10 the length of the attachment plate 12 should be determined by the length by the specifics of the make and model of the target bass boat. For the purposes of this description, measurements are based on a 21' 2006 Ranger® Bass Boat. The attachment plate 12 should be cut from ⅜" aluminum plate with a length of 38¼" and a width of 3½" on one end of the attachment plate 12 and 7½" on the opposite. On the 3½" end of the attachment plate 12, cut a hole with a diameter of 1¾" and with a center positioned 1¼" from the end and 1¾" from both sides. On the 7½" end of the attachment plate 12, cut two rectangular holes, both 1¾"×⅜". These two slots should be ¾" away from the 7½" end of the attachment plate 12 and 2 7/16" from each side. The slots will then be 1⅞" apart. These slots will accommodate the attachment brackets 16.

The anchor post 13 will be cut from 1.75" OD aluminum tubing with a wall thickness of ⅛". Bore a ⅜" hole into the bottom of the anchor post 13. The center of this hole should be positioned ⅜" above the bottom of the anchor post 13 and ⅞" from both sides. Bore a ½" hole with a center 1" from the top and ⅞" from the sides of the anchor post 13. The center of both holes should be aligned.

The attachment brackets 16 will be cut from ⅜" aluminum plate. The attachment brackets 16 will be 1¾" wide with ¼" rounded ends on the top. Bore one ¼" hole ⅞" from the top and ⅞" from each side. Bore a second ¼" hole 1⅜" from the bottom of the attachment brackets 16 to the center and ⅞" from each side. The center of the holes should be aligned vertically.

The stanchion member 11 should be cut from 1.75" OD aluminum tubing with a ⅛" wall thickness. The stanchion member 11 will be 36" long. On one end a diagonal wedge is cut to allow the stanchion member 11 to pivot from stowed to upright positions and back. The wedge is ⅞"×⅞" (45 degree angle). Bore two ¼" holes on the wedge cut end. The holes should be ¾" and 2½" from the wedge end and should align. The holes should extend through both sides of the stanchion member 11.

The end cap 14 will cover the stanchion member 11 on one end.

The locking pin 20 and pivot pin 21 are to be inserted into the stanchion member 11 and extend through the attachment brackets 16.

Next, insert the anchor post 13 ¼" into the attachment plate 12 and weld the top of the anchor post 13 to the attachment plate 12. Then, weld the bottom of the attachment plate 12 to the anchor post 13. Insert the attachment brackets 16 into the two slots on the 7½" wide end of the attachment plate 12 so that they are flush with the bottom and weld top and bottom of the attachment plate 12 to the attachment brackets. Align the holes in the stanchion member 11 with the holes in the attachment brackets 16 and insert the pivot pin 21 into the lower bracket aperture 19 of the attachment brackets. Stand the stanchion member 11 upright in order to insert the locking pin. Insert the locking latch 22 into the anchor post 13 so that the two flat sections lock into the two holes in the anchor post 13. The standing support assembly 10 is now ready to be inserted into a base plate on the floor of a bass boat.

Once the standing support assembly 10 has been inserted into such a base plate, it can pivot left or right (sliding along the floor of the bass boat) to accommodate for needed space and maneuverability of the boaters. When a boater is ready to move from the seated area to either the back or front fishing decks of the boat, they will hold the standing support assembly 10 with the stanchion member 11 in the deployed position for balance and safer movement. Boaters will also use the standing support assembly 10 with the stanchion member 11 in the deployed position to return from the front or back fishing decks to the seated area of the boat.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A standing support assembly for a boat deck having a base plate disposed on a surface of the boat deck, the standing support assembly comprising:

an attachment plate having a top side and a bottom side, wherein said bottom side is adapted to attach to the base plate at a first end of the attachment plate such that the first end is a rotatably fixed fulcrum point of the attachment plate that allows the attachment plate to rotate about the first end; and a stanchion member pivotably coupled with the top side of said attachment plate at a second end of the attachment plate opposite from the first end, wherein said stanchion member pivots between a deployed position and a storage position, and wherein the deployed position includes the stanchion member being disposed perpendicularly with respect to the attachment plate and the storage position includes the stanchion member being disposed substantially parallel to the attachment plate.

2. The standing support assembly of claim 1, additionally comprising an anchor post extending from the bottom side of said attachment plate at the first end, wherein said anchor post adapts the attachment plate to attach to the base plate.

3. The standing support assembly of claim 1, additionally comprising at least one attachment bracket which includes at least one bracket aperture that passes through the attachment bracket, wherein said attachment bracket is integral with the attachment plate, extending from the top side of the attachment plate.

4. The standing support assembly of claim 3, wherein said stanchion coupled with the attachment plate by being hinged to the at least one attachment bracket.

5. The standing support assembly of claim 4, wherein said attachment bracket is configured to prevent the stanchion member from moving outside of the range between the deployed position and the storage position.

6. The standing support assembly of claim 4, wherein said stanchion member is hinged to said at least one attachment bracket through a locking pin that passes through the stanchion member and the at least one bracket aperture.

7. The standing support assembly of claim 6, wherein:

said at least one bracket aperture defines two discrete bracket apertures;

said attachment plate is configured to prevent the stanchion member from moving outside of the range between the deployed position and the storage position through a pivot pin positioned in one of said discrete bracket apertures.

8. A standing support assembly for a boat deck having a base plate disposed on a surface of the boat deck, the standing support assembly comprising:

a rigid, elongated attachment plate having a top side and a bottom side, such that a first end of the attachment plate is a rotatably fixed fulcrum point of the attachment plate that allows the attachment plate to rotate about the first end;

a rigid, elongated stanchion member movably coupled with the top side of said attachment plate at a second end of the attachment plate, wherein said stanchion member is movable between a deployed position in which the stanchion member is orthogonal to the attachment plate and a storage position;

an anchor post extending from the bottom side of said attachment plate at second end, wherein said anchor post adapts the attachment plate to attach to a base plate.

9. The standing support assembly of claim 8, additionally comprising at least one attachment bracket which includes at least one bracket aperture that passes through the attachment bracket, wherein said attachment bracket is integral with the attachment plate, extending from the top side of the attachment plate, said stanchion coupled with the attachment plate by being hinged to the at least one attachment bracket, and said attachment bracket is configured to prevent the stanchion member from moving outside of the range between the deployed position and the storage position.

* * * * *